US005962983A

United States Patent [19]

Anderson et al.

[11] Patent Number: 5,962,983

[45] Date of Patent: Oct. 5, 1999

[54] METHOD OF OPERATION OF DISPLAY PANEL

[75] Inventors: Edward C. Anderson, Northwood; David E. Olm, Toledo; Jerry D. Schermerhorn, Perrysburg, all of Ohio

[73] Assignee: Electro Plasma, Inc., Millbury, Ohio

[21] Appl. No.: 09/016,585

[22] Filed: Jan. 30, 1998

[51] Int. Cl.[6] ..... H05B 37/02

[52] U.S. Cl. ..... 315/169.4; 345/88

[58] Field of Search ..... 315/169.4, 169.1; 345/75, 60, 62, 65, 66, 67, 78, 88, 55; 313/584, 585, 586, 484, 485, 491, 492

[56] References Cited

U.S. PATENT DOCUMENTS 4,638,218 1/1987 Shinoda et al. ..... 315/169.4
4,737,687 4/1988 Shinoda et al. ..... 315/169.4
5,661,500 8/1997 Shinoda et al. ..... 345/60
5,723,945 3/1998 Schermerhorn ..... 313/581
5,825,128 10/1998 Betsui et al. ..... 315/169.4

*Primary Examiner*—Michael B Shingleton
*Attorney, Agent, or Firm*—MacMillan, Sobanski & Todd, LLC

[57] ABSTRACT

A method of driving AC plasma display panels by initiating sustain and address discharges to groove sidewalls in the substrate and forming lateral discharges along the groove. A write step applies a pulse to selected first and second electrodes corresponding to cells on a row that will be turned "ON", and an erase step applies a voltage to first and third electrodes corresponding to cells that are to be turned "OFF".

18 Claims, 13 Drawing Sheets

METHOD OF OPERATION OF DISPLAY PANEL

FIELD OF INVENTION

This invention relates to a display panel having micro-grooves and a method of operation of the display panel. More particularly, this invention relates to a full color, high resolution capable AC Plasma Display Panel, commonly known as a PDP, having micro-grooves on the back-plate forming a metal on groove (MOG) structure and a method and an apparatus for driving a lateral discharge in the AC PDP using the metal on groove (MOG) structure. Such displays have application for computer screens and TV screens and the like.

BACKGROUND OF THE INVENTION

A flat-panel display is an electronic display in which a large orthogonal array of display devices, such as electro-luminescent devices, AC plasma display panels, DC plasma panels and field emission displays and the like form a flat screen.

The basic structure of an AC Plasma Display Panel, or PDP, comprises two glass plates with a conductor pattern of electrodes on the inner surfaces of each plate and separated by a gas filled gap. The conductors are configured in an x-y matrix with horizontal electrodes and vertical column transparent electrodes deposited at right angles to each other using thin-film techniques well known in the art. The electrodes of the AC-plasma panel display are covered with a thin glass dielectric layer. The glass plates are assembled together to form a sandwich with the distance between the two plates fixed by spacers. The edges of the plates are sealed and the cavity between the plates is evacuated and back-filled with neon and argon or a similar gas mixture. When the gas ionizes, the dielectrics charge like small capacitors so the sum of the drive voltage and the capacitive voltage is large enough to excite the gas contained between the glass plates and produce a glow discharge. As voltage is applied across the row and column electrodes, small light emitting pixels form a visual picture.

Barrier ribs are typically disposed between the foregoing insulating substrates so as to prevent cross-color and cross-pixel interference between the electrodes and increased resolution to provide a sharply defined picture. The barrier ribs provide a uniform discharge space between the glass plates by utilizing the barrier ribs height, width and pattern gap to achieve a desired pixel pitch. For example, barrier ribs of plasma display panels most desirably have a configuration of about 100 $\mu$m in height and are as narrow as possible, preferably less than 20 $\mu$m in width and spaced at about 120 $\mu$m pitch. This requirement is necessary in order to achieve a color pixel pitch of 72 lines per inch, the printing industry standard point of type, which is equivalent to a sub-pixel pitch of 216 lines per inch with a red, green and blue phosphor stripe color arrangement. This pattern is commonly used to achieve color output in flat panel and many cathode ray tube displays with diagonal dimensions on the order of 20 to 40 inches used for displaying graphic and textual information in computer terminal equipment and television receivers.

An alternative geometry for an AC PDP is given according to U.S. patent application Ser. No. 08/629,723, incorporated herein by reference. In a PDP of this type, the backplate is manufactured by first constructing an array of microgrooves, metalizing the recessed surfaces of the microgrooves, applying a phosphorescent material on the microgroove surfaces co-incident with the metalized surfaces, and sealing with a front plate containing a dielectrically isolated conductor array generally orthogonal to the microgroove array, i.e., metal on groove (MOG) structure.

Flat panel displays, such as AC plasma display panels (AC-PDPs) are desired to have large screens, large capacity, and the ability to display full-color images. In particular, the AC PDPs are desired to provide more display lines and intensity levels and reliably rewrite their screens without decreasing the luminance of the screens.

In view of the foregoing, it is an object of the invention to provide a method and apparatus for driving the metal on groove (MOG) structure of an AC plasma display, which due to its geometry must operate differently than the prior art. It is a further object to apply voltage waveforms in such a way as to increase light output without increasing electrode width. Another object of the present invention is to provide a method and an apparatus for driving a lateral discharge plasma display panel that is capable of displaying at least 256 shades of gray.

SUMMARY OF THE INVENTION

Briefly, according to this invention there is provided a method of operating an AC plasma flat-panel display having a hermetically sealed gas filled enclosure. The enclosure includes a top glass substrate and a bottom substrate spaced from top glass substrate. The top glass substrate has an array of paired top electrodes and an electron emissive and insulating film covering the top electrodes. The bottom substrate has a plurality of parallel micro-grooves arranged orthogonally to the top electrodes and a bottom electrode formed of metal and deposited within each micro-groove having a bottom and side-walls and a phosphor material deposited on and coincident with each bottom electrode thereby forming sub-cell pairs called sub-pixels at the projected intersections of the top electrodes forming rows and microgrooves forming columns.

The method comprises the steps of:

applying a sustain step comprised of a applying a first voltage to the first electrodes of the top electrode pairs and a reference voltage to all bottom electrodes, the difference of sufficient magnitude to cause an initiating discharge to the sidewalls of the bottom electrodes intersected at the Paschen minimum only for sub-cells which have charges stored under corresponding top substrate electrodes, and applying a second voltage, of opposite polarity to the first voltage, to the second electrodes paired with the first electrodes which creates a lateral discharge between virtual electrodes, formed by the initiating discharges to the sidewalls, between sub-cells pairs at a pressure gap product value greater than the Paschen minimum, maintaining the voltages until the discharges extinguish thereby depositing charges under the top electrodes of opposite polarity, applying first terminating voltages to the first top electrodes and second terminating voltages to the second top electrodes as required to sweep residual charges in gas volume, and reversing the polarities of the first and second top electrodes and repeating the sequence continuously in conjunction with optional selective addressing steps comprising:

applying a selective write step comprised of applying a write voltage of common polarity to a preceding or co-incident sustaining voltage to a first electrode of one or more pairs of top electrodes and a selective write voltage to selected bottom electrodes, the difference of sufficient magnitude to cause a discharge to sidewalls of all bottom electrodes intersected at the Paschen minimum, applying a write voltage of common polarity to a preceding or co-incident sustaining voltage to a first electrode of one or more pairs of top electrodes and an inhibit voltage to unselected bottom electrodes, the difference of sufficient magnitude to not cause a discharge to sidewalls of all bottom electrodes intersected, applying a second write voltage, of opposite polarity to the first, to the second electrode paired with the first electrode, and form lateral discharges between virtual electrodes formed by the discharges to sidewalls between sub-cells pairs at pressure gap product values greater than the Paschen minimum, and maintaining the voltages until discharges extinguish thereby depositing and storing charges on the dielectric coating under the top electrodes; and a selective erase step comprised of:

applying an erase voltage of opposite polarity to a preceding sustaining voltage to a first electrode of one pair of top electrodes and a column voltage to selected bottom electrodes, the resulting voltage of combined magnitude sufficient to cause a discharge to sidewalls of the selected bottom electrodes at the Paschen minimum but only at subcell sites which have charges stored under corresponding top electrodes, and maintaining the voltages until discharges extinguish thereby removing stored charges which prevent discharging at subsequent sustain steps.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
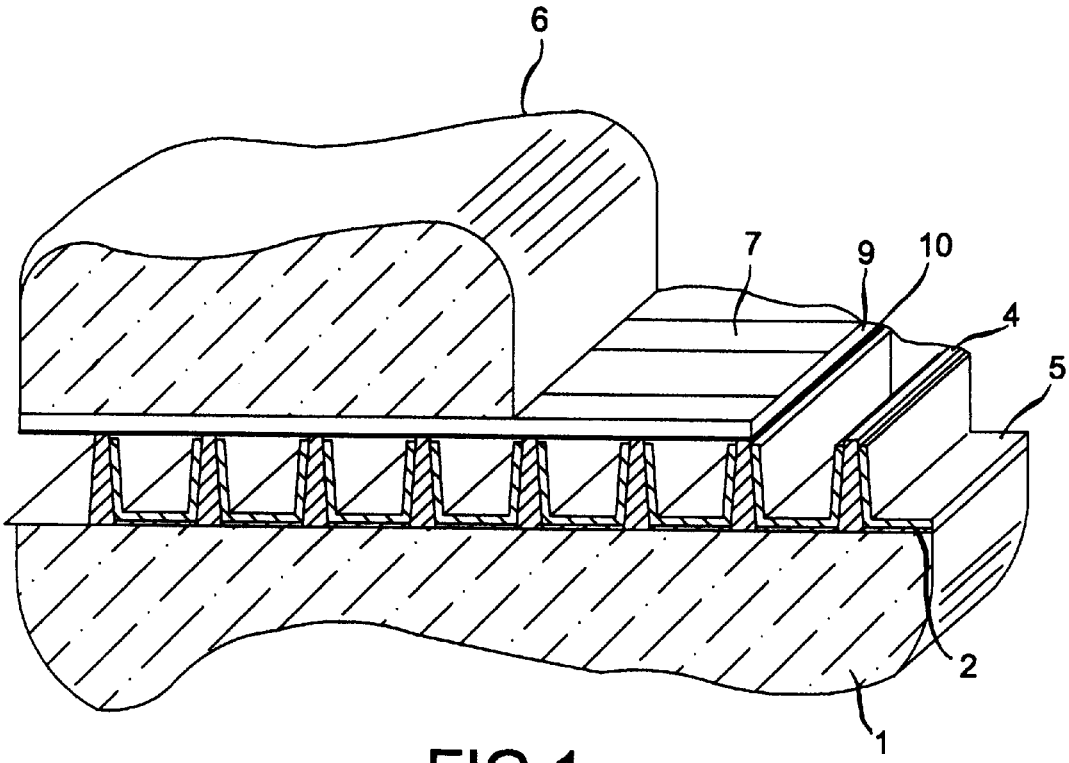
FIG. 1 illustrates a typical structure of an AC color plasma display.
Figure 4A:
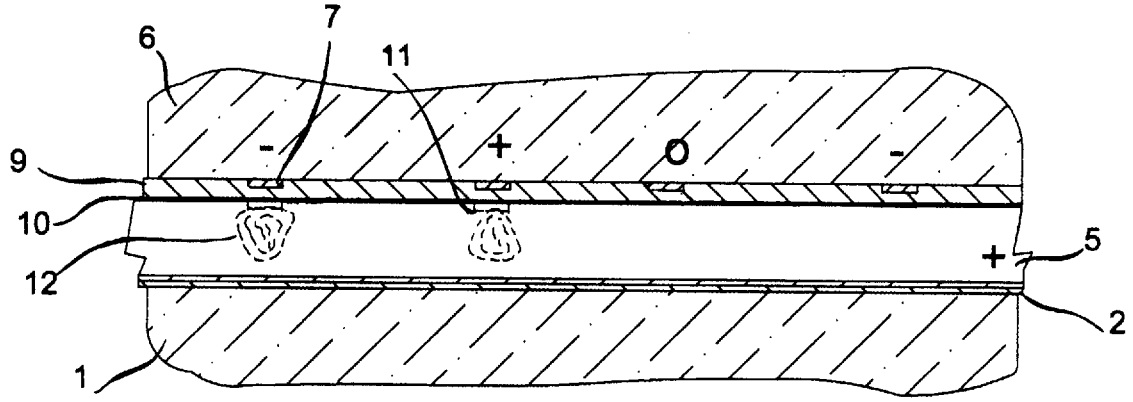
FIGS. 4*a*–4*d* illustrate the formation of the discharge in a lateral discharge AC plasma display panel.
Figure 4B:
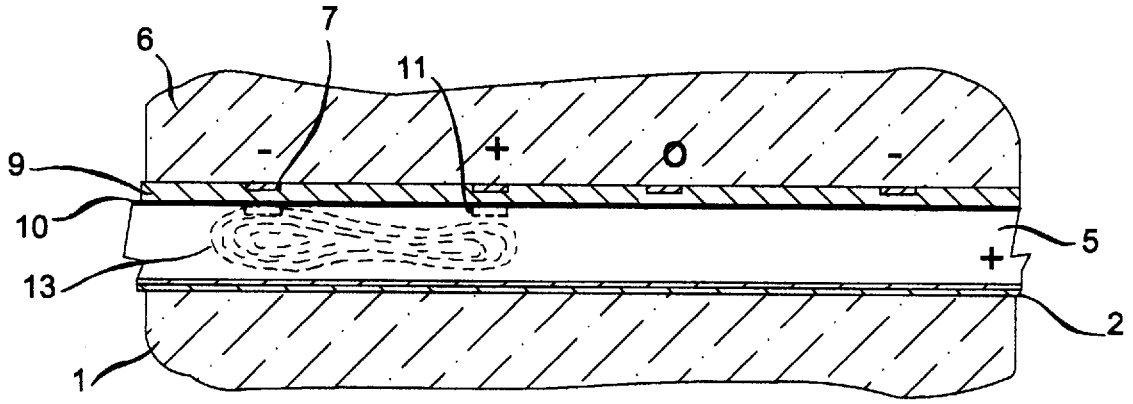
Figure 4C:
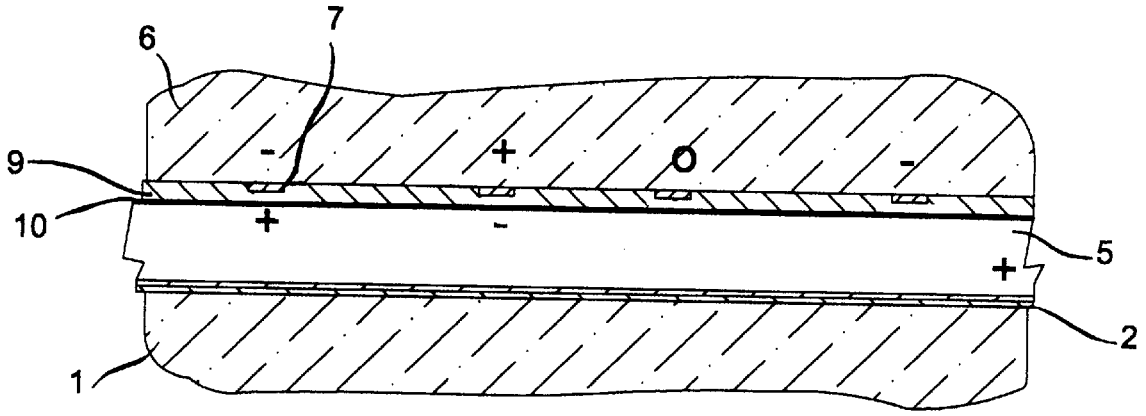
Figure 4D:
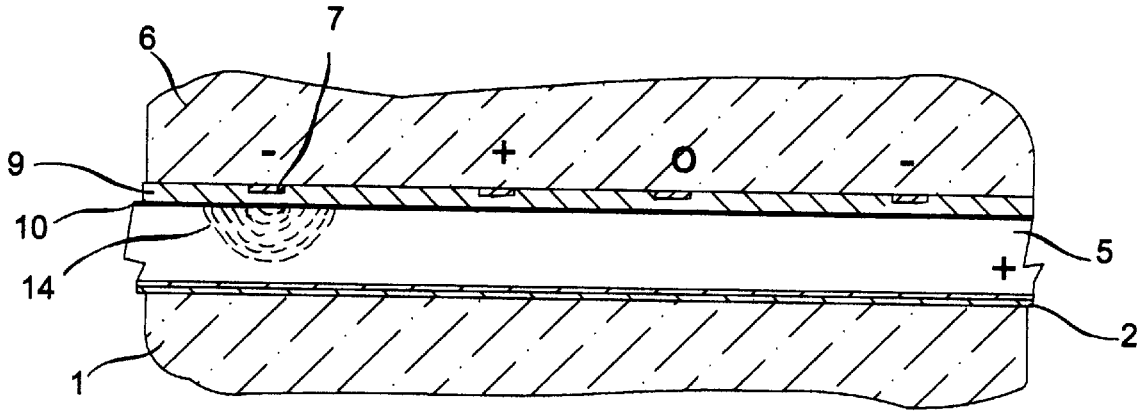
Figure 5:
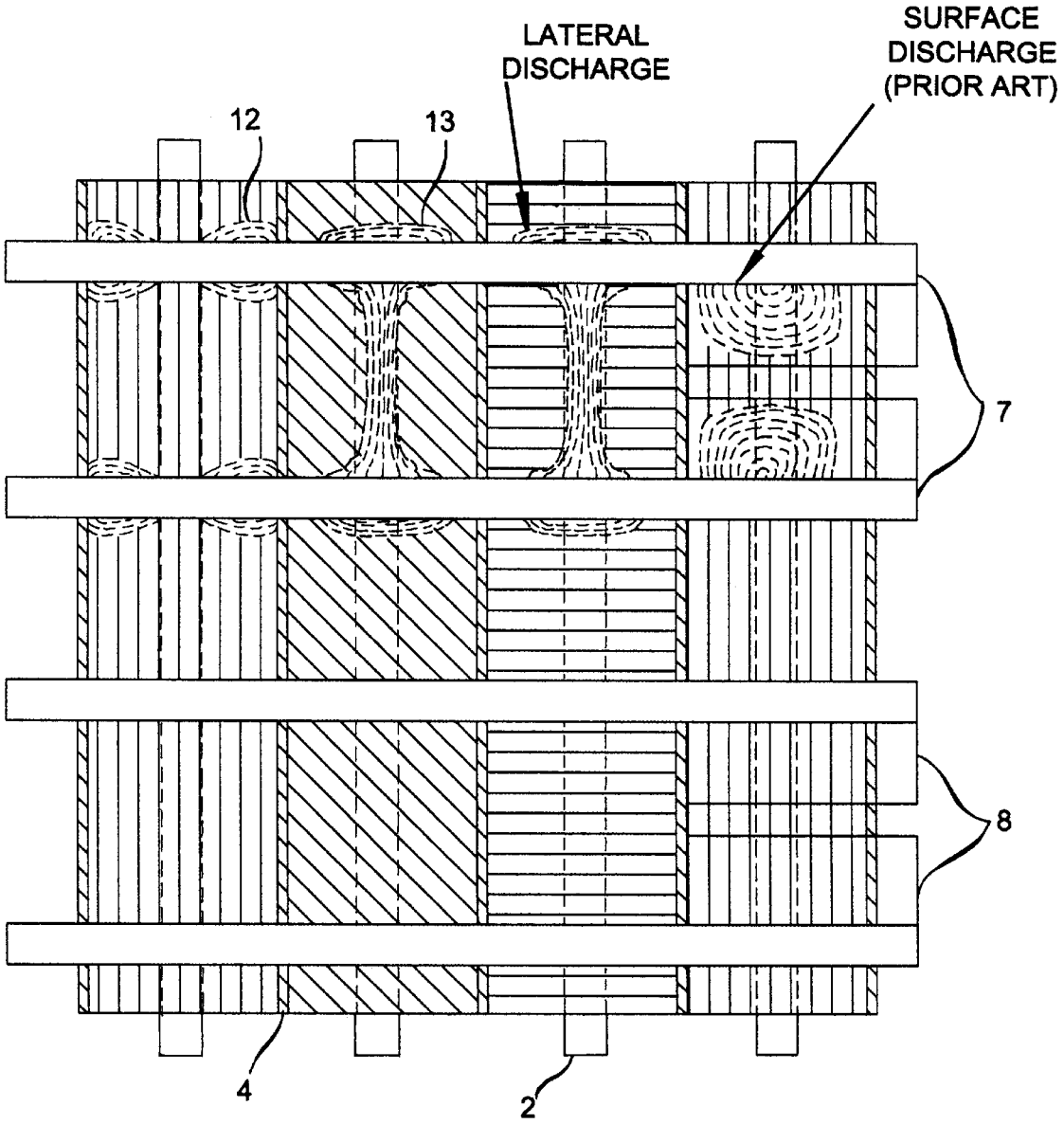
FIG. 5 illustrates the light output pattern from the surface discharge plasma display panel of FIG. 2 and the light output from the lateral discharge structure.

Referring to FIGS. 1, 4, and 5; wherein like reference characters represent like elements, a partial cross-sectional view of a full color display is shown. The color display is obtained using a selective combination of three different colors. A front or top substrate has on its interior surface display electrodes 7, also referred to as Y and Z sustainer electrodes, covered with dielectric material 9 which has applied to its surface a photoemissive layer 10. The front substrate is sealed to a back substrate 1 containing luminescent areas 5 on the surfaces of microgrooves separated by a thin barrier 4. On the luminescent areas 5 are deposited phosphor material on which is coincident with electrodes 2 covering the interior surfaces of the micro-grooves. Each adjacent luminescent area may contain different phosphor color, for example, red [R], green [G], and blue [B] in a repetitive pattern. An image element is typically defined by at least three luminescent areas 5 corresponding to the above three colors.

For a more detailed discussion of the full color display, reference is made to U.S. patent application Ser. No. 08/629,723, incorporated herein by reference In a prior art method shown in FIG. 2 and 3, a surface discharge type AC plasma display panel having a three electrode structure is shown. A plurality of parallel display electrode pairs 7 are formed on a front substrate 6 and a plurality of address electrodes 2 perpendicular to the display electrode pairs are formed on a rear substrate 1. The front substrate display electrodes are covered with dielectric material 9 which has applied to its surface a photoemissive layer 10 and the address electrodes are covered with dielectric material 3. Barrier ribs 4 are formed over the dielectric material 3 and phosphorus material 5 is deposited between the barriers. The phosphors are arranged on the substrate facing the display electrode pairs with a discharge space between the phosphor and the display electrode pairs and are excited by ultra-violet rays generated from a surface discharge between the display electrodes, thereby causing luminescence. See, for example, U.S. Pat. Nos. 4,638,218; 4,737,687; and 5,661,500, incorporated herein by reference.

Figure 2:
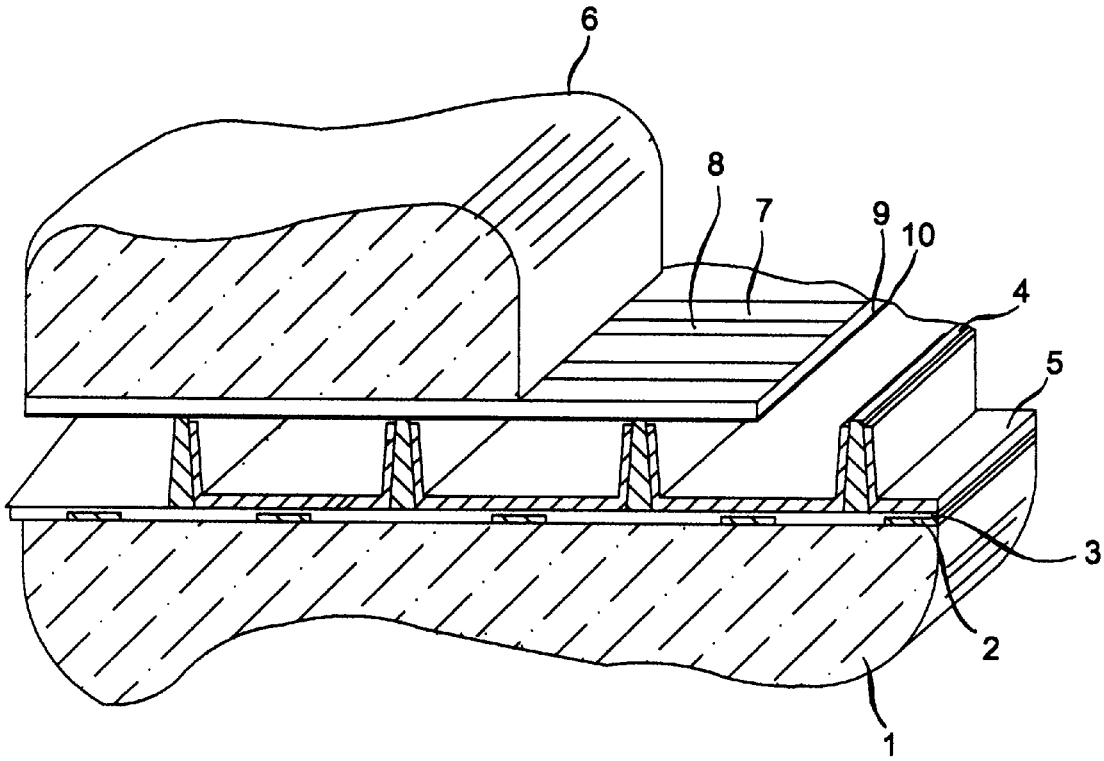
FIG. 2 illustrates a structure of a surface discharge AC plasma display panel.

In the prior art driving method for the surface discharge structure shown in FIG. 2, a reset step of applying a pulse of a first voltage to the paired first and second display electrodes; a write step of applying a pulse of a second voltage to the second and third electrodes corresponding to cells to be turned "ON"; and a sustain discharge step of applying an AC pulse of a fourth voltage to the paired first and second electrodes, wherein the pulse of the first voltage being set so that it erases all cells in the display. A write step is performed in which cells of the first display line to be turned "ON" receive a pulse of the second voltage, cells of the second line to be turned "ON" receive a pulse of the second voltage, cells of the third display line to be turned "ON" receive a pulse of the second voltage, etc. until all cells in the display have been written.

Figure 3A:
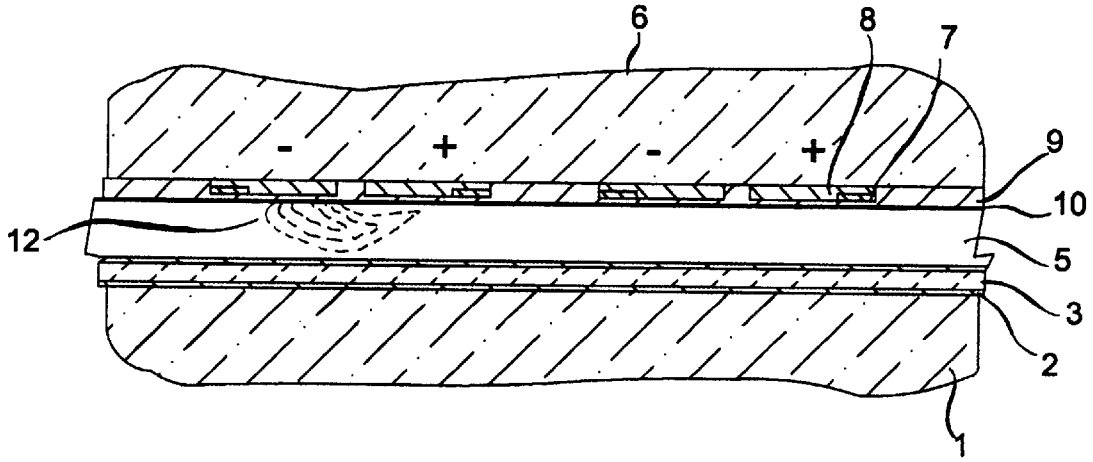
FIGS. 3*a*–3*c* illustrate the formation of the discharge in a surface discharge AC plasma display panel.
Figure 3B:
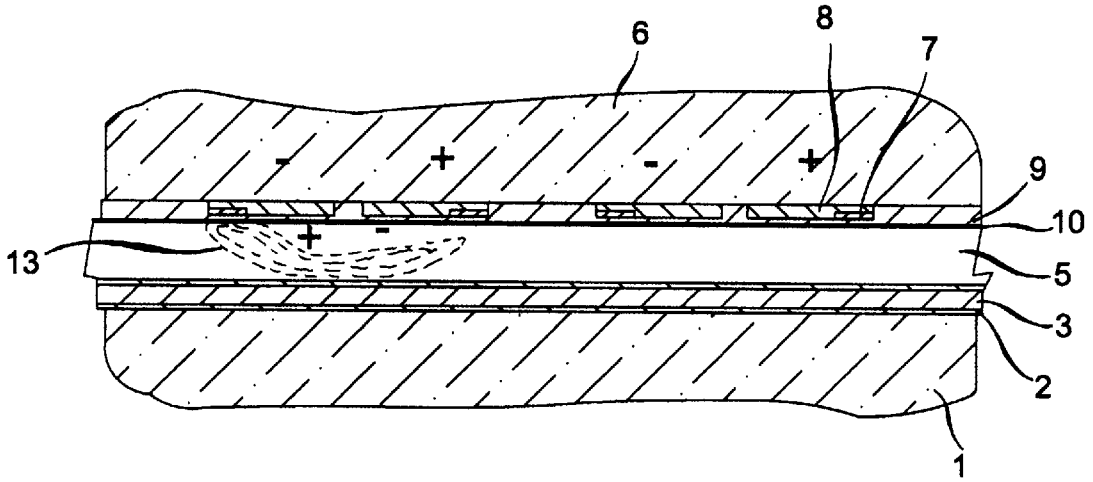
Figure 3C:
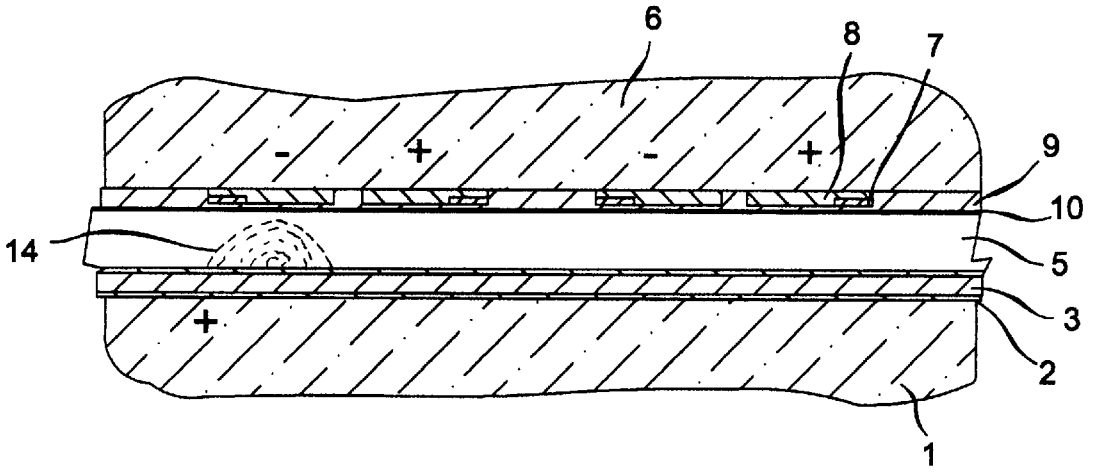

The application of this sequence of voltages results in a surface discharge as shown in FIG. 3 wherein the parallel electrodes 7 of the front plate have been widened by the application of a transparent electrode 8 typically composed of Indium Tin Oxide (ITO). FIG. 3*c* illustrates that the write voltage applied to the display electrode 7 and the address electrode 2 forms a discharge 14 between the front substrate 6 and back substrate 1. The resulting discharge accumulates charges on the front substrate 6 and back substrate 1. The charges on the front substrate 6 must be large enough so that on application of the next sustain pulse, a discharge will occur between the two display electrodes 7. The resulting discharge 12 forms across the narrow gap between the display electrodes as shown in FIG. 3*a*. FIG. 3*b* illustrates that as the discharge 13 progresses, it elongates to cover the entire width of the display electrodes and forms charges on both the front display electrodes and the rear address electrodes. The light output resulting from the surface discharge can be seen in FIG. 5 as it is formed by the display electrodes 7.

Figure 14:
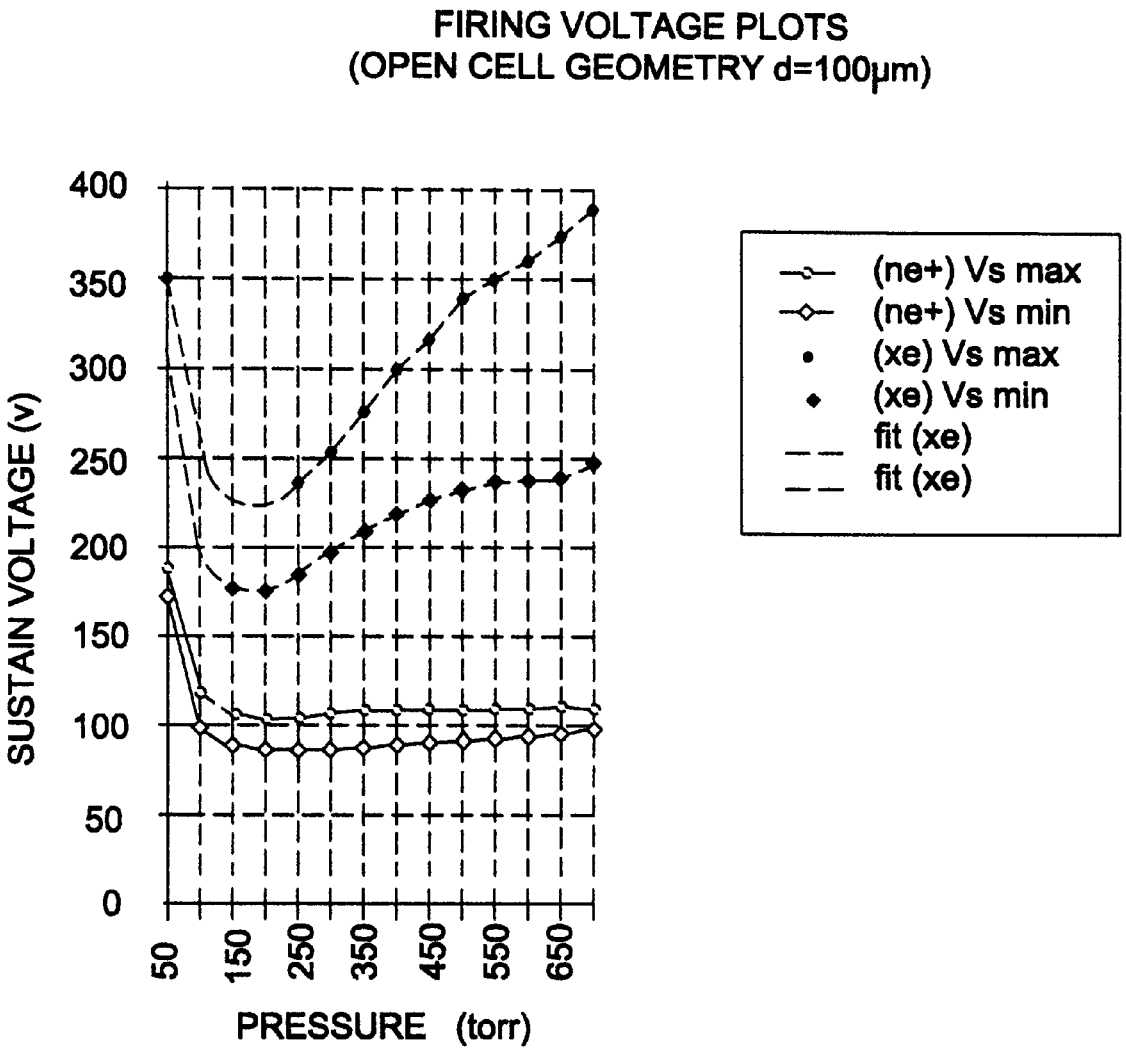
FIG. 14 is a sample Paschen Curve for an open cell structure PDP.

The sustaining and operating conditions of prior art displays are set by the gas physics relating primarily to a Paschen Curve which has the shape indicated in FIG. 14. In heretofore known prior art displays, discharges must occur on the right hand side of the Paschen Curve. That is, above the minimum and in a region where decreasing P×d (product of pressure and distance) causes decreasing operating voltage. This is essential to the sustaining mechanism, because otherwise as the discharge begins a virtual cathode and anode i.e., virtual electrode II, is established which effectively shortens the gap (d) and the discharge would self-extinguish prematurely. On the other hand, it also forces unwanted charge build-up on the dielectrics covering the address electrodes, which must be compensated for in the addressing schemes.

This surface discharge structure results in an increase in light output as a result of the addition of ITO to the display electrodes by passing light that would otherwise be hidden behind the electrodes. It also allows a wider discharge area that results in an increase in light but with a corresponding increase in current. It will be appreciated that this transparent material must be applied over the normal electrode material and requires an unwanted alignment step in the forming of the front substrate material.

FIG. 4 illustrates the formation of a lateral discharge in an AC plasma display in accordance with the present invention. Referring to the display electrodes 7 formed on the front substrate 6, a sustain voltage Va is applied to the display electrodes such that an "ON" cell with wall voltage Vw will remain on when:

$$Va+Vw>Vfmax_1+Vfmax_2 \qquad \text{I}$$

where $Vfmax_1$ is the maximum required firing voltage for a discharge 12 to occur from the Y display electrode to the address electrode 2 and $Vfmax_2$ is the maximum required firing voltage for a discharge to occur between the Z display electrode and the address electrode as shown in FIG. 4*a* for Phase I of the sustaining discharge. Va+Vw must also be less than the required firing voltage $Vfmax_3$ that is necessary to begin a discharge between the display electrodes Y and Z. As these discharges develop, Phase II of the discharge begins wherein the gas ionizes and the discharge spreads forming the discharge 13 shown in FIG. 4*b* which occurs between virtual anode and cathode i.e., virtual electrode II, formed over the display electrodes during Phase I. This discharge causes Phase III of the discharge wherein charges (+and −) are collected on the surface of the front substrate such that the voltage cross the cell decreases and the discharge extinguishes. The discharge may be made to re-occur by reversing the applied voltage across the display electrodes and thus causing the discharge to reverse with corresponding reversal in the wall charge. This sequence of reoccurring discharges is known as sustaining.

It will be appreciated that there is no wall charge collected on the address electrode since there is no dielectric material covering these electrodes. It will be further appreciated that the discharges to the walls of a MOG structure develop at the region of the minimum on the Paschen curve during the first stage of sustaining and will occur somewhere along the microgroove side-wall. Because such a discharge will begin to self-extinguish due to the development of a virtual cathode and anode i.e., virtual electrode", there is only a small amount of current that occurs between the front and back substrate and the probability of damaging the phosphor is minimized. This is important to maintain long display life. Further, because the d of the P×d product, as described above, is small, the starting voltage for the MOG device is minimized automatically.

During Phase II of the lateral discharge, the virtual cathode and anode formed by Phase I will then develop a discharge laterally between themselves. The spacing between the electrode sustain pair on the front plate will now determine the firing voltage and path for the lateral discharge phase. This spacing can be designed relatively independently of the groove depth and display voltages and the light-output more optimally adjusted.

For example, if the electrode pair spacing is made large, the discharge appears quite long like a thread of light formed laterally along the length of the groove cavity. In this case there is sputtering primarily at the electrode positions and therefore sputtering damage is limited to only a small area of the discharge cell surface. This design is ideal for low power, high resolution devices, but the efficiency tends to be rather low because one must choose a gas mixture commensurate with practical voltages, and the longer the discharge path the higher the sustaining voltage.

Figure 15:
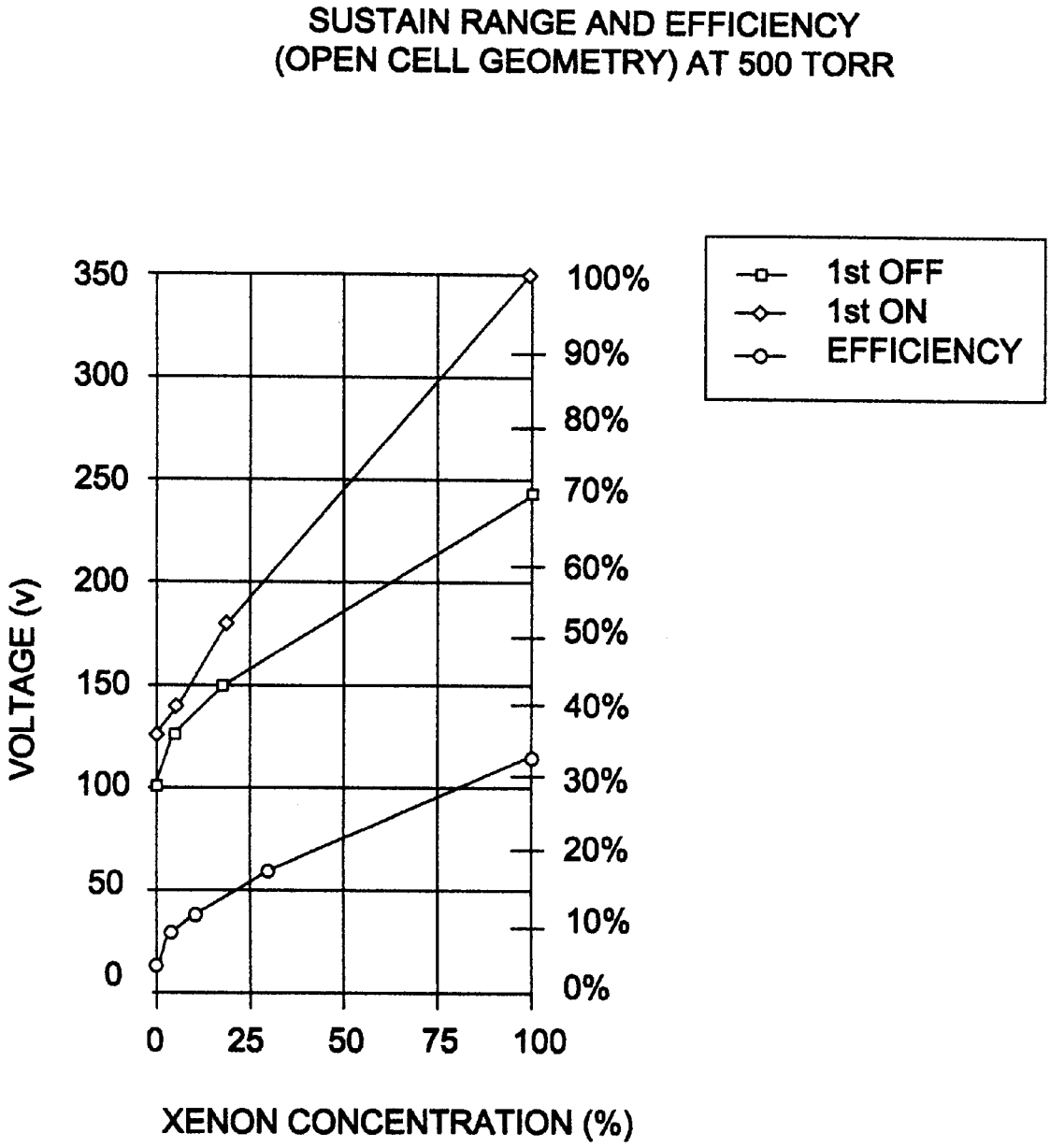
FIG. 15 is a sample Voltage and Efficiency Plot with varying gas composition.

An examination of the relation between efficiency, gas mixture, and operating voltage as plotted for illustration in FIG. 15 leads one to a design with a higher voltage gas mixture. This can be accommodated with the MOG structure more easily than the prior art because, even with high sustain voltages, addressing voltages can be made lower.

FIG. 4*d* illustrates the addressing technique for the MOG structure wherein a write pulse of voltage Vpw is applied to one display electrode 7 and the address electrode 2. Vpw must be greater than the required firing voltage $Vfmax_1$ described above. The applied pulse results in a small discharge between the front display electrode and the address electrode. This discharge causes wall charge to collect on the front substrate of Vwa such that Va+Vpw+Vwa is greater than $Vfmax_1+Vfmax_2$ so that on the preceding sustain waveform transition, sustaining Phase I as shown in FIG. 4*a* is developed and the cell is turned "ON".

To erase a cell, the wall charge shown in FIG. 4*c* must be reduced so that equation I described above is not met. This is accomplished by causing a discharge between one of the front display electrodes and the address electrode. In this case, the resulting discharge causes a wall charge to be placed on the front surface that is of the same polarity as that of the second display electrode. For example, if the Y display electrode in FIG. 4*c* contains a positive wall charge and the Z display electrode has a negative wall charge, causing a discharge between the Y electrode and address electrode may be accomplished by application of a positive voltage to the Y electrode and a negative voltage to the address electrode. The result of this discharge will be to place a negative charge over the Y electrode. Since both Y and Z now contain a negative wall charge, the wall voltage is reduced and the conditions of equation I will not be met and the cell will be extinguished.

Figure 6:
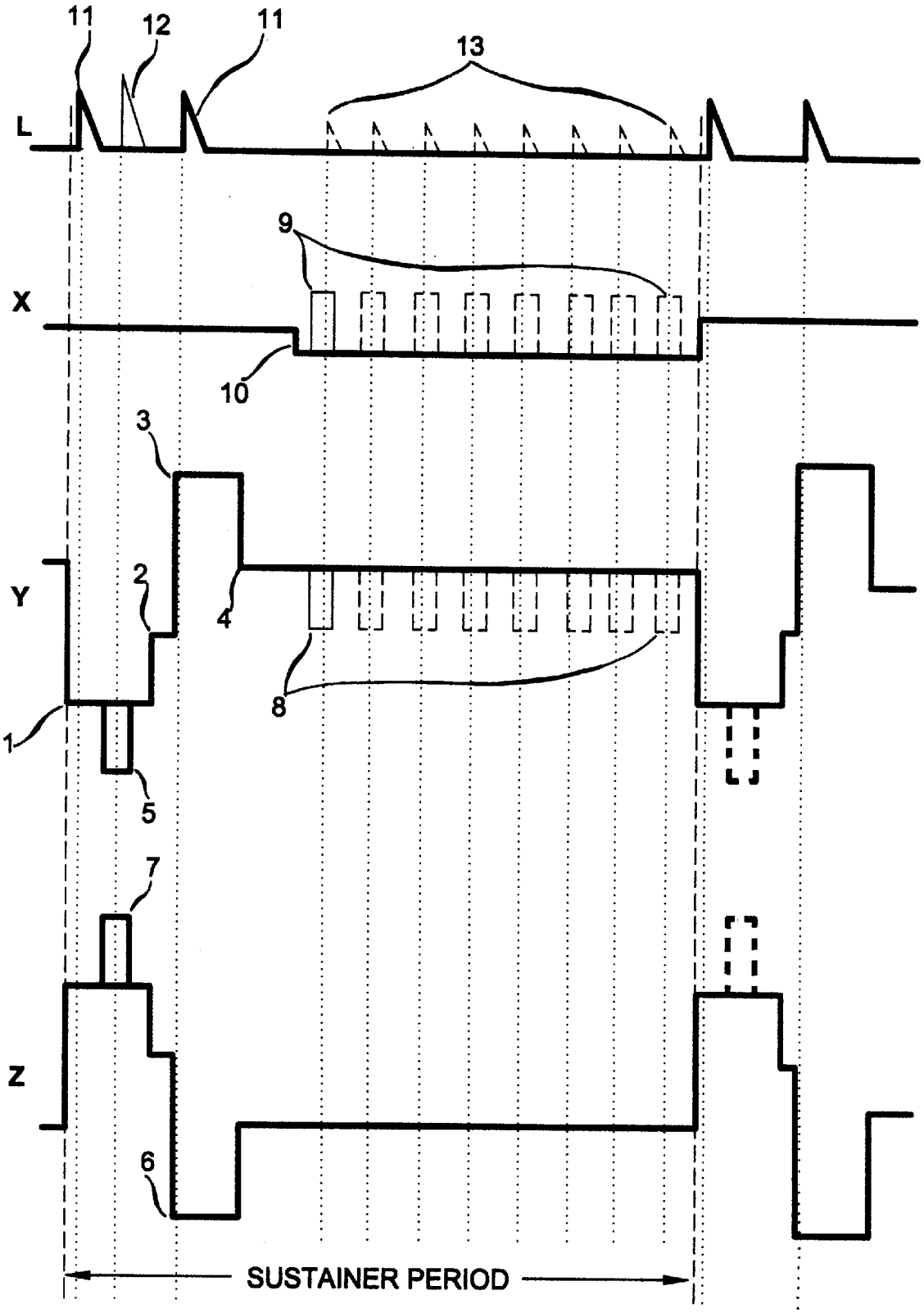
FIG. 6 illustrates the a waveform used for addressing and sustaining the MOG plasma display.

FIG. 6 illustrates the waveforms of a preferred embodiment of the present invention that meet the necessary requirements for driving the MOG structure. In FIG. 6, L represents the light output from a selected cell, X is the waveform applied to the address electrode of the selected cell, Y is the voltage applied to the Y display electrode of the selected cell, and Z is the Z voltage applied to the Z electrode of the selected cell. Y and Z are of equal amplitude and are of opposite polarity. As Y transitions to the low level 3, Z transitions to the high level 1 and thus a voltage is applied to the cell of amplitude Va and this causes a previously "ON" cell to discharge resulting in a light output pulse 12. At the next step, Y transitions to the high level 1, Z transitions to the low level and this results in the application of a negative voltage to the cell of amplitude Va and the "ON" cell again discharges and creates a light output. If the previous state of the cell was "OFF", the transitions of Y and Z will not be large enough to cause the "OFF" cell to discharge and the cell will remain in the "OFF" condition.

Write addressing is shown in FIG. 6 as the application of a negative pulse 5 to the Y display electrode and a positive pulse 7 to the Z display electrode. If the height of the pulse 5 is $Vw_1$ and the height of pulse 7 is $Vw_2$, then the voltage across the addressed cell is $Va+Vw_1+Vw_2$ and this voltage must be greater than $Vfmax_1+Vfmax_2$ described above in order to cause a discharge between the two display electrodes. The application of these pulses causes the cells on the line formed by the Y and Z electrode to discharge and collect wall charges on the front substrate of sufficient amplitude so that on the next transition of the Y and Z electrodes (indicated by 6 in FIG. 6), the cell again discharges and becomes "ON". In this manner, all cells on the horizontal line formed by the Y and Z electrodes will be written.

Not all cells on the addressed horizontal line should remain in the "ON" state. It therefore becomes necessary to selectively erase those cells must be "OFF". This is accomplished by the application of erase pulses 8 to the Y display electrode and erase pulses 9 to the address electrode X. If the height of the Y pulse 8 is $Vw_1$, a common supply can be used to generate both the write and erase pulse heights for the Y electrode resulting in a simplification of the power supply for the display. The address pulse height 9 of value $Ve_1$ must then be chosen so that $Vw_1+Ve_1$ must be greater than $Vfmax_1$ in order to cause a discharge between the Y electrode and the address electrode X in order for the selected cell that is to be turned "OFF". The application of the erase pulse results in a wall charge of same polarity for the Y and Z electrode and the wall voltage is reduced to a level that does not satisfy equation I and the cell is extinguished.

In a preferred method of updating pixel information, eight horizontal lines are written at the same time using the same pulses 5 and 7 shown in FIG. 6. Eight separate erase pulses are then sequentially applied to those eight lines. Each of the erase pulses is used to extinguish unwanted cells on those eight addressed lines. This is illustrated in FIG. 6 where horizontal lines L1, L2, . . . L8 have all cells written with pulses 5 and 7 and then the first erase pulse 8 is used to selectively erase the unwanted cells on L1, the second pulse is used to selectively erase the unwanted cells on L2, the third pulse is used to selectively erase the unwanted cells on L3, etc. until all eight lines have unwanted cells in the "OFF" state.

Figure 7A:
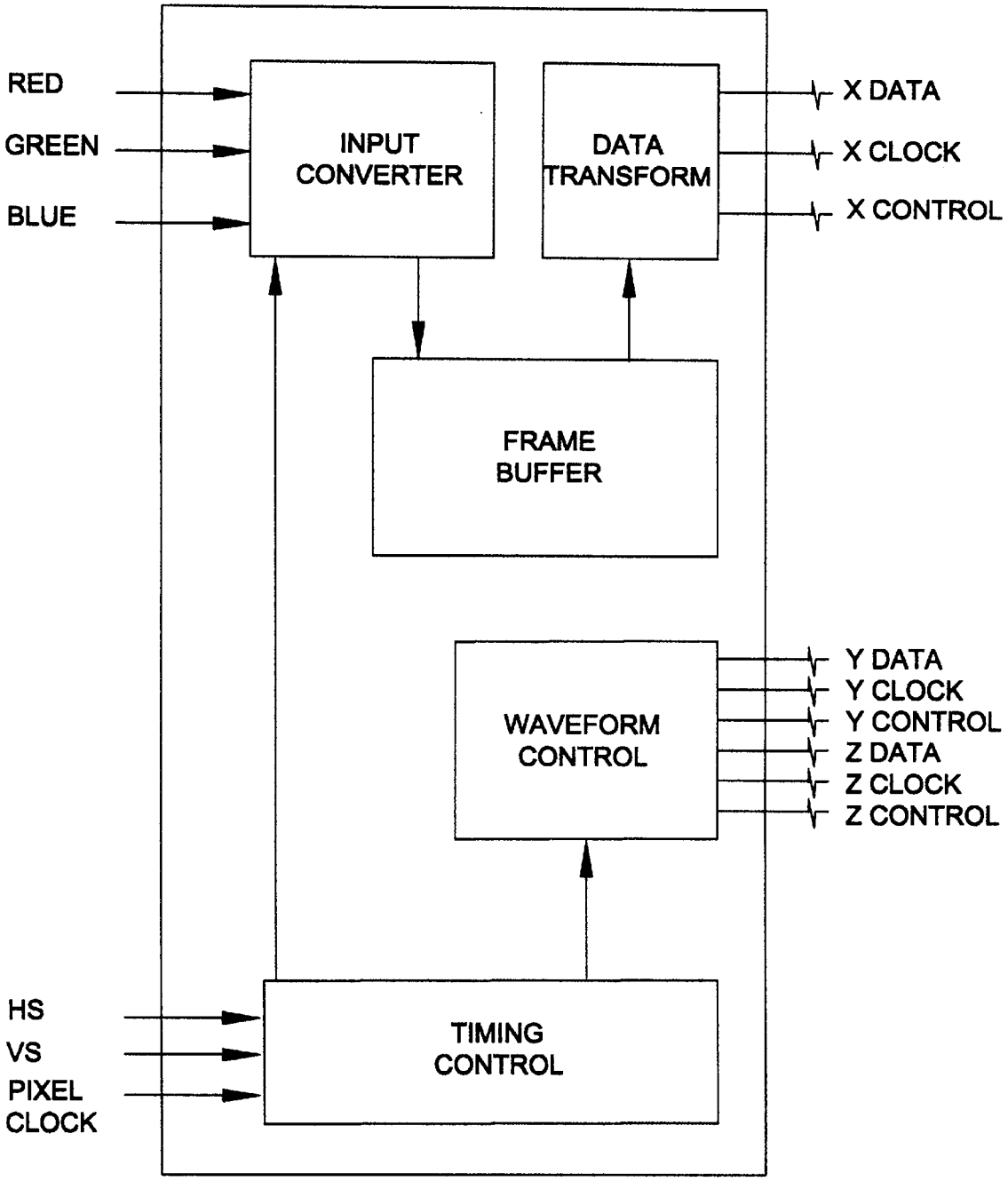
FIG. 7 is a block diagram of the apparatus used to generate the waveform of FIG. 6.
Figure 7B:
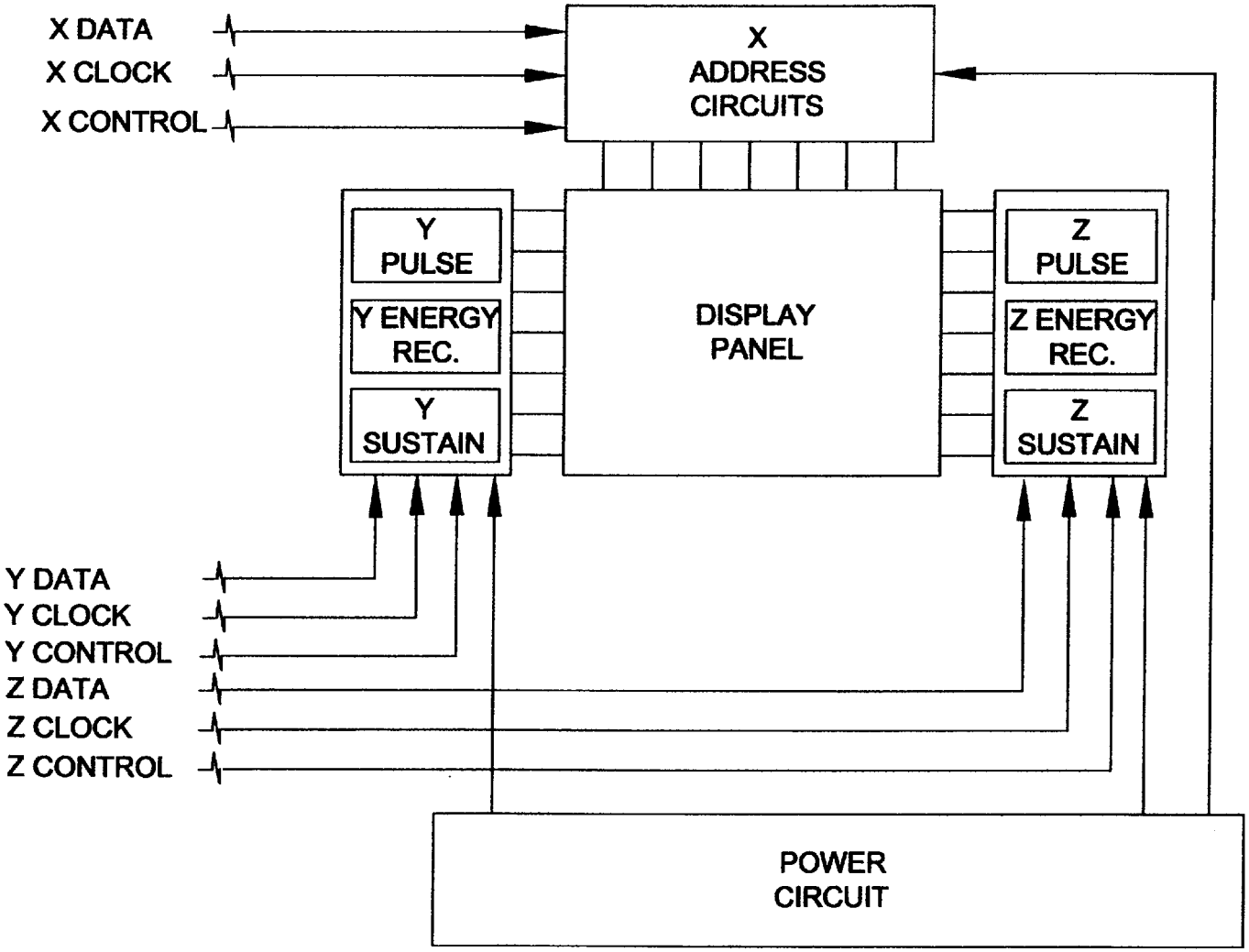

FIG. 7 illustrates the block diagram of a system that is used to generate the waveforms and data necessary to drive the MOG structure. The input to the system is control signals for identifying the horizontal and vertical synchronizing signals, the data for red, green, and blue information for each pixel in the display and a clock to indicate new pixel information. The pixel data is converted to binary form and stored in a frame memory of a type well known in the art for later retrieval. The Timing Control unit synchronezes with the sync signals and controls the waveform generator. The waveform generator is responsible for sending horizontal address information to the Y and Z drive circuits, and for generating signals that are used to generate the Y and Z waveforms. Horizontal lines are written in groups of eight and the waveform control unit selects which horizontal lines make up the selected set. The selected group are bulk written and then the those lines are selectively erased.

The Data Transform block selects information from the frame buffer based on the selected horizontal line to be erased and other information, such as how grayscale value is to be used for selecting the erase pattern. Thus the Data Transform block is responsible for manipulating the frame buffer data so that desired information can be properly displayed on the plasma screen.

Figure 8:
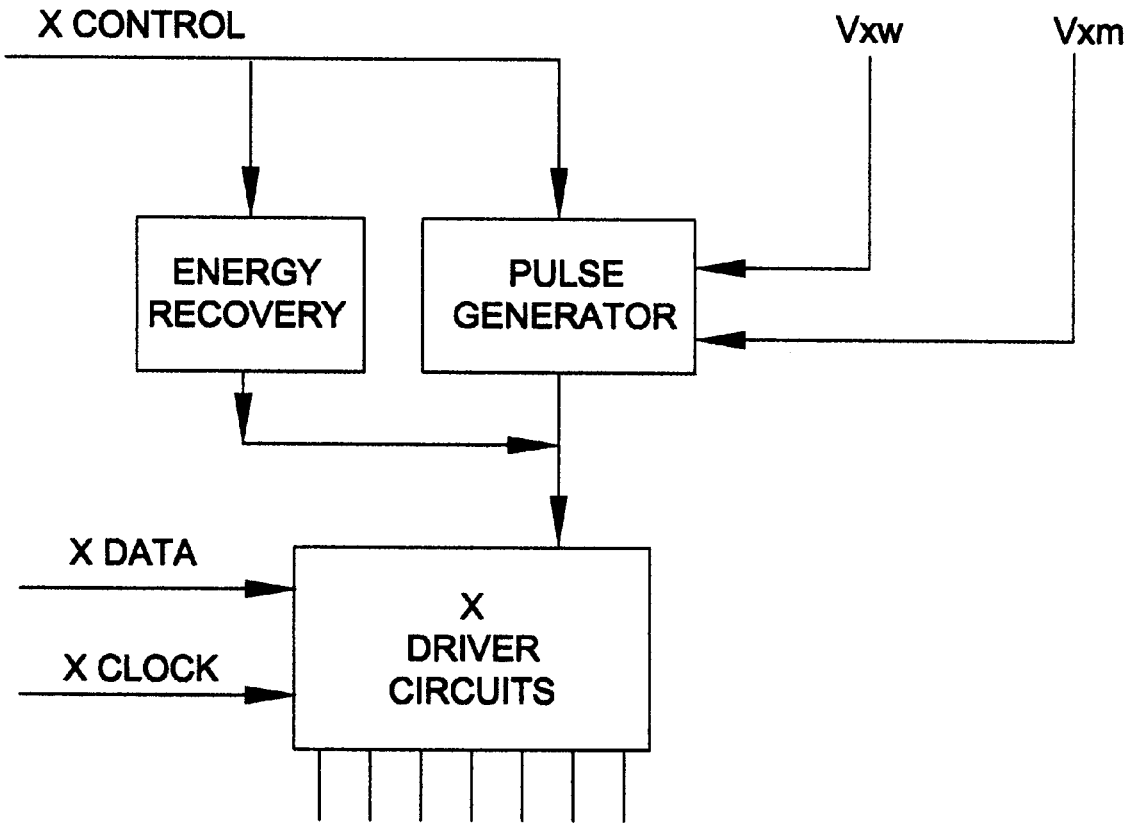
FIG. 8 is a block diagram of the X driving system.

FIG. 8 illustrates the detailed block diagram for the address electrode (X) drive circuit. The Pulse Generator selects one of three levels to apply to the driver circuits. The Vxw level is used to generate the pulse height of the erase pulses for selected cells, the ground levels is used for unselected cells, and the Vxm level is used when no erase pulses are being generated during the normal sustain time. Energy recovery circuits are used to increase efficiency when driving the capacitance of the address electrodes and is used for both the address pulse voltages (Vxw) and the Vxm level. Data to the X drive circuits is determined by the Data Transform block shown in FIG. 7.

Figure 9:
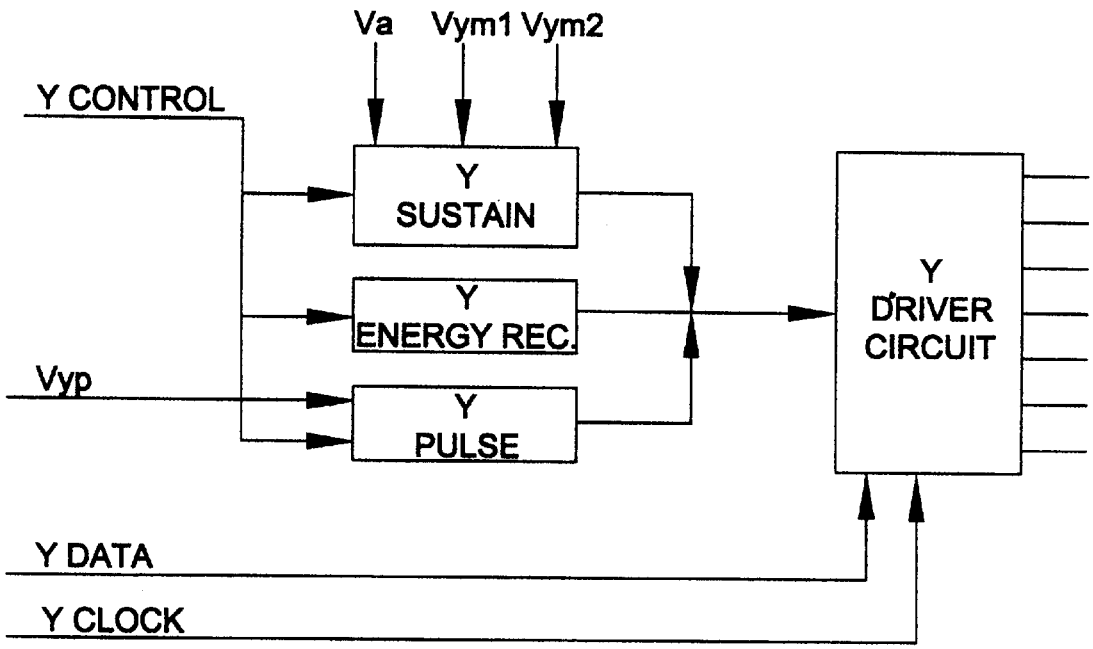
FIG. 9 is a block diagram of the Y driving system.

FIG. 9 illustrates the detailed block diagram for the Y display electrode drive circuit. The Y Sustain block generates the sustaining waveform 2 shown in FIG. 6. The controls for the timing of the waveform are determined by the Waveform Control block of FIG. 7. The Y Sustain Block selects between the sustain voltage Va and the two intermediate levels $Vym_1$ and $Vym_2$. $Vym_2$ is the level from which erase pulses are applied. Energy recovery circuits are used to increase efficiency when driving the capacitance of the address electrodes and is used for both the sustain voltage (Va) and the Vym levels. Erase and write address pulses are generated by the Y Pulse control block. The same pulse height is used for both erase and write pulses. The Y driver circuit chooses lines to write and erase based on Y data from the Waveform Control block. The data is used to apply or not apply the erase and write pulses to each of the horizontal lines in the display.

Figure 10:
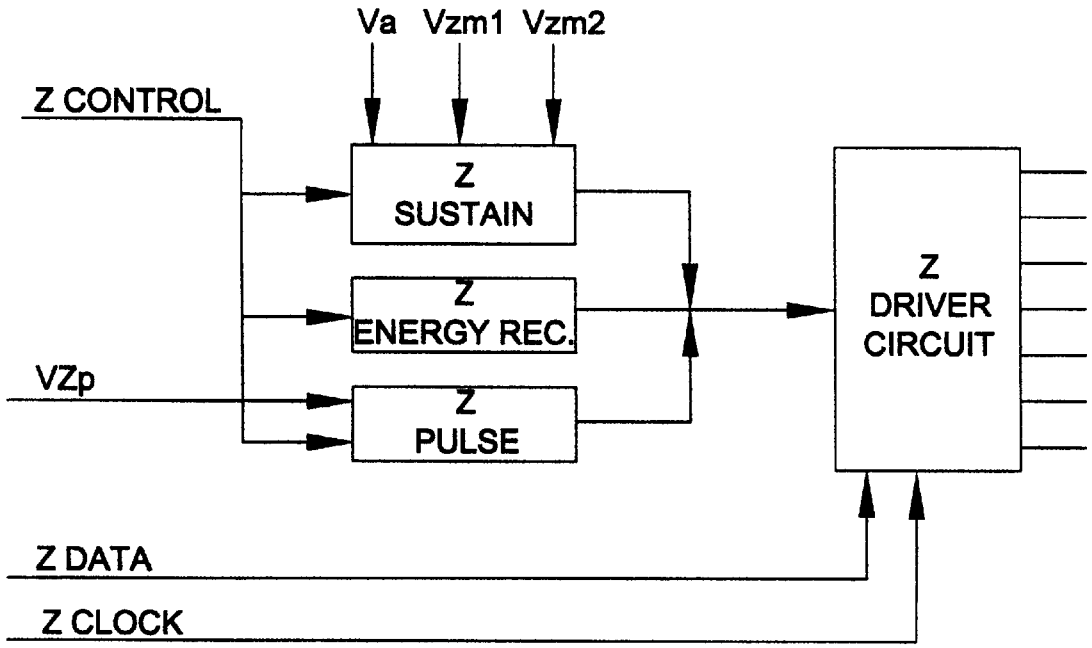
FIG. 10 is a block diagram of the Z driving system.

FIG. 10 illustrates the detailed block diagram for the Z display electrode drive circuit. The Z Sustain block generates the sustaining waveform 6 shown in FIG. 6. The controls for the timing of the waveform is determined by the Waveform Control block of FIG. 7. The Z Sustain Block selects between the sustain voltage Va and the two intermediate levels $Vzm_1$ and $Vzm_2$. $Vzm_2$ is the level from which erase pulses are applied. Energy recovery circuits are used to increase efficiency when driving the capacitance of the address electrodes and is used for both the sustain voltage (Va) and the Vzm levels. Write address pulses are generated by the Z Pulse control block. The Z driver circuit chooses lines to write based on Z data from the Waveform Control block. The data is used to apply or not apply the write pulses to each of the horizontal lines in the display as required. It will be appreciated that since the Z and Y block diagrams are so closely related, the same circuitry can be used for both the Z and Y electrodes. This results in a savings of both design, assembly, and circuit costs.

Figure 11:
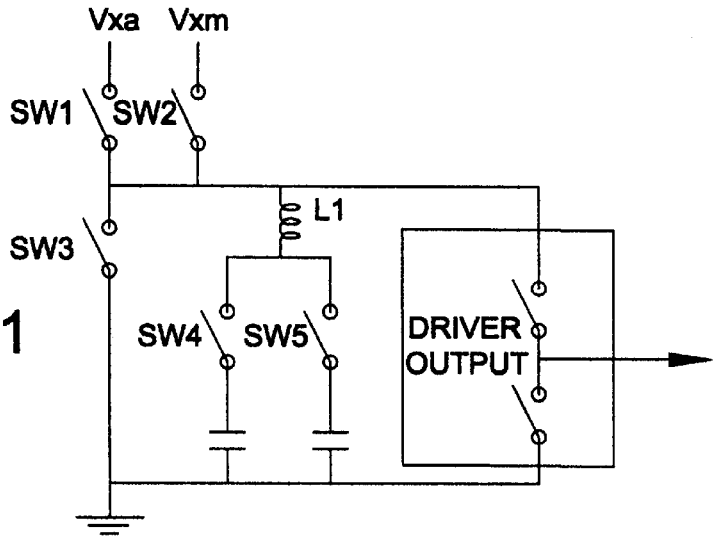
FIG. 11 is a schematic diagram of the X driving system.

FIG. 11 schematically illustrates a typical circuit for generating the required waveform for the (X) electrodes. Switches SW1, SW2 and SW3 control the voltage that will be applied to the driver. The two switches inside the driver device select either the applied voltage (when the upper switch is "ON", lower switch is "OFF") or the common level ground (when the lower switch is "ON", upper switch is "OFF"). The driver switches are controlled by the data bits loaded into the driver circuit by the Data Transform block shown in FIG. 7. SW1 of FIG. 11 is closed and SW2 and SW3 are open whenever the address electrode is to be pulsed with voltage VAX. SW2 is closed and SW1 and SW3 are open whenever there is only sustain activity and X is held at the medium voltage Vxm. SW3 is closed and SW1 and SW2 are open whenever the address electrode is to be at the ground level. This occurs between the address erase pulses. Energy recovery is performed by switches SW4 and SW5. SW4 is closed whenever the applied voltage is to transition from ground to Vxa or from Vxa to ground. On the transition from Vxa to ground, the capacitor is charged through the inductor L1. On the transition from ground to Vxa, the capacitor is discharged through the inductor L1. Thus the capacitor average voltage will be ½ Vxa. Energy recovery for the Vxm levels is accomplished by SW5. SW5 is closed whenever the applied voltage is to transition from ground to Vxm or from Vxm to ground. On the transition from Vxm to ground, the capacitor is charged through the inductor L1. On the transition from ground to Vxm, the capacitor is discharged through the inductor L1. Thus the capacitor average voltage will be ½ Vxm. It is important to have only one switch closed at any given time. SW4 and SW5 are used for the transitions and SW1, SW2, and SW3 are used to clamp the voltages at their corresponding levels.

Figure 12:
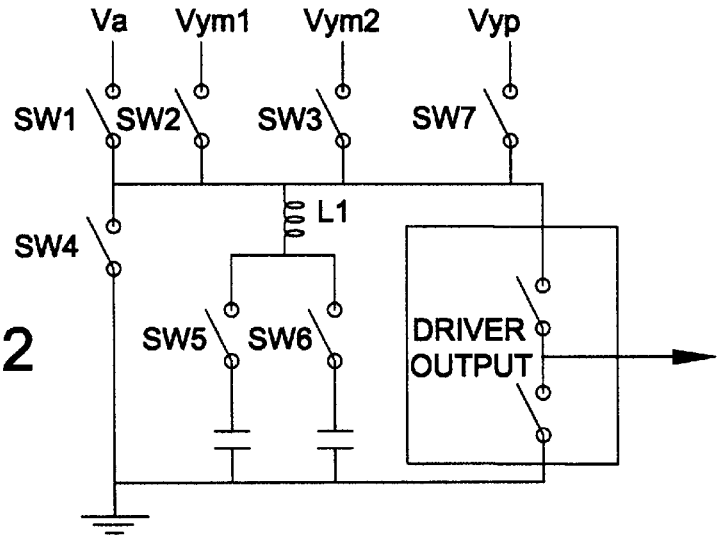
FIG. 12 is a schematic diagram of the Y driving system.

FIG. 12 schematically illustrates a typical circuit for generating the required waveform for the Y display electrode. Switches SW1, SW2, and SW3 control the voltage that will be applied to the Y driver. The two switches inside the driver device select either the applied voltage (when the upper switch is "ON", lower switch is "OFF") or the common level ground (when the lower switch is "ON", upper switch is "OFF"). The driver switches are controlled by the data bits loaded into the driver circuit by the Waveform Control block shown in FIG. 7. SW1 of FIG. 12 is closed and SW2, SW3, and SW4 are open whenever the display electrode is to be pulsed with the sustaining voltage Vya. SW2 is closed and SW1, SW3 and SW4 are open whenever the sustain waveform is to be held at intermediate voltage Vym1. SW3 is closed and SW1, SW2, and SW4 are open whenever the display electrode is to be at the second intermediate level $Vym_2$. This occurs during the address erase pulses. Sw4 is closed and SW1, SW2, and SW3 are open whenever the display electrode is to be at the ground level. Switches SW5 and SW6 perform energy recovery. SW5 is closed whenever the applied voltage is to transition from $Vym_1$ to Vya or from Vya to $Vym_1$. On the transition from Vya to $Vym_1$, the capacitor is charged through the inductor L1. On the transition from $Vym_1$ to Vya, the capacitor is discharged through the inductor L1. Thus the capacitor average voltage will be ½ ($Vya+Vym_1$). Energy recovery for the $Vym_2$ levels is accomplished by SW6. SW6 is closed whenever the applied voltage is to transition from ground to $Vym_2$ or from $Vym_2$ to ground. On the transition from Vxm to ground, the capacitor is charged through the inductor L1. On the transition from ground to Vxm, the capacitor is discharged through the inductor L1. Thus the capacitor average voltage will be ½ $Vxm_2$. It is important to have only one switch closed at any given time. SW4 and SW5 are used for the transitions and SW1, SW2, and SW3 are used to clamp the voltages at their corresponding levels.

Figure 13:
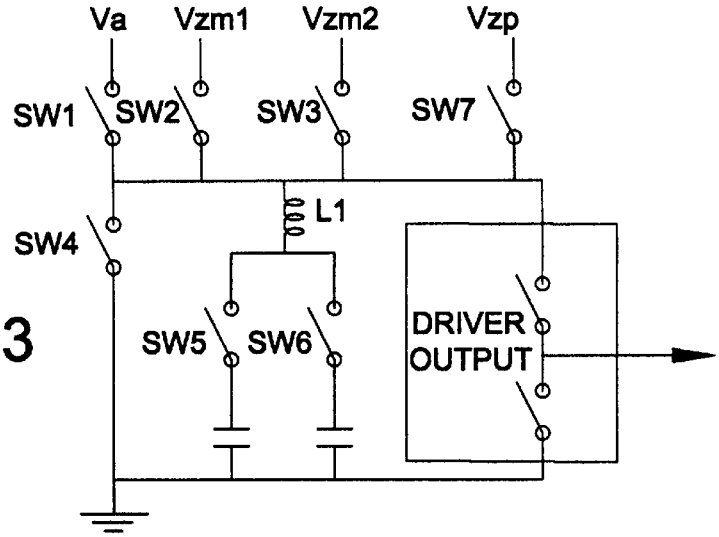
FIG. 13 is a schematic diagram of the Z driving system.

FIG. 13 schematically illustrates a typical circuit for generating the required waveform for the Z display electrode. Switches SW1, SW2, and SW3 control the voltage that will be applied to the Z driver. The two switches inside the driver device select either the applied voltage (when the upper switch is "ON", lower switch is "OFF") or the common level ground (when the lower switch is "ON", upper switch is "OFF"). The driver switches are controlled by the data bits loaded into the driver circuit by the Waveform Control block shown in FIG. 7. SW1, of FIG. 13 is closed and SW1, SW3, and SW4 are open whenever the display electrode is to be pulsed with the sustaining voltage Vza. SW2 is closed and SW1, SW3 and SW4 are open whenever the sustain waveform is to be held at intermediate voltage $Vzm_1$. SW3 is closed and SW1, SW2, and SW4 are open whenever the display electrode is to be at the second intermediate level $Vzm_2$. This occurs during the address erase pulses. SW4 is closed and SW1, SW2, and SW3 are open whenever the display electrode is to be at the ground level. Switches SW5 and SW6 perform energy recovery. Energy recovery for the Z display electrode is similar to that described above for the Y display electrode. It is important to have only one switch closed at any given time. SW4 and SW5 are used for the transitions and SW1, SW2, and SW3 are used to clamp the voltages at their corresponding levels.

The patents and documents referenced herein are hereby incorporated by reference in their entirety.

Having described presently preferred embodiments of the present invention, it is to be understood that it may be otherwise embodied within the scope of the appended claims.

What is claimed is:

1. A method of operating an AC plasma flat-panel display having a hermetically sealed gas filled enclosure including a top transparent substrate and a bottom substrate spaced from but in contact with top substrate, the top substrate having an array of paired top electrodes and an electron emissive and insulating film covering the top electrodes; the bottom substrate having a plurality of parallel micro-grooves arranged orthogonally to the top electrodes forming gas filled cavities; a bottom electrode formed of metal and deposited within each micro-groove having a bottom and side-walls; and a phosphor material deposited on and coincident with each bottom electrode thereby forming sub-cell pairs called sub-pixels at the projected intersections of the top electrodes forming rows and microgrooves forming columns, wherein the method comprises the steps of:

applying a sustain step comprised of applying a first voltage to the first electrodes of the top electrode pairs and a reference voltage to all bottom electrodes, the difference of sufficient magnitude to cause an initiating discharge to the sidewalls of the bottom electrodes intersected at the Paschen minimum only for sub-cells which have charges stored under corresponding top substrate electrodes to form a virtual electrode, and applying a second voltage, of opposite polarity to the first voltage, to the second electrodes paired with the first electrodes which forms a virtual electrode and then creating a lateral discharge between the virtual electrodes between sub-cells pairs at a pressure gap product value greater than the Paschen minimum, maintaining the voltages until the discharges extinguish thereby depositing charges under the top electrodes of opposite polarity, applying first terminating voltages to the first top electrodes and second terminating voltages to the second top electrodes as required to sweep residual charges in gas volume, and reversing the polarities of the first and second top electrodes and repeating the sequence continuously in conjunction with optional selective addressing steps comprising:

applying a selective write step comprised of:

applying a write voltage of common polarity to a sustaining voltage to a first electrode of one or more pairs of top electrodes and a selective write voltage to selected bottom electrodes, the difference of sufficient magnitude to cause a discharge to sidewalls of all bottom electrodes intersected at the Paschen minimum, applying a write voltage of common polarity to a sustaining voltage to a first electrode of one or more pairs of top electrodes and an inhibit voltage to unselected bottom electrodes, the difference of sufficient magnitude to not cause a discharge to sidewalls of all bottom electrodes intersected, applying a second write voltage, of opposite polarity to the first, to the second electrode paired with the first electrode, and form lateral discharges between virtual electrodes formed by the discharges to sidewalls between sub-cells pairs at pressure gap product values greater than the Paschen minimum, and maintaining the voltages until discharges extinguish thereby depositing and storing charges on the dielectric coating under the top electrodes; and a selective erase step comprised of:

applying an erase voltage of opposite polarity to a sustaining voltage to a first electrode of one pair of top electrodes and a column voltage to selected bottom electrodes, the resulting voltage of combined magnitude sufficient to cause a discharge to sidewalls of the selected bottom electrodes at the Paschen minimum but only at sub-cell sites which have charges stored under corresponding top electrodes, and maintaining the voltages until discharges extinguish thereby removing stored charges which prevent discharging at subsequent sustain steps.

2. The method of claim 1 wherein the inhibit voltage during the selective write step is set equal to the selective write voltage for all bottom electrodes thereby causing rows, all sub-pixels along a selected top electrode pair, to be written in one step.

3. The method of claim 2 wherein a bit image, or one bit per pixel, is written into the display successively but not required sequentially by constructing a sequence of sustain steps or cycles according to the following manner:

a cycle is performed consisting of one or more sustain cycles wherein at least one sustain cycle contains a write step consisting of a group of rows selected and written to "on" and a selective erase step consisting of a number of erase pulses corresponding to the number in the group, addressed sequentially but within the same sustain cycle in which cells to be "off" are erased and those to be "on" left unaffected, thereafter, a second cycle is performed with a second group of rows in a like manner, and sequential cycles are performed until all possible groups have been addressed and the display updated to the new bit image.

4. The method of claim 1 wherein all first and second voltages and terminating voltages on paired top electrodes are equal and opposite.

5. The method of claim 1 wherein the write voltage is of negative polarity.

6. The method of claim 1 wherein the erase voltage is of negative polarity.

7. The method of claim 1 wherein the column voltage is of positive polarity.

8. The method of claim 1 wherein the column voltage is ground referenced.

9. The method of claim 4 wherein the average voltage on the top substrate electrodes is biased to be near ground thereby minimizing voltages between all electrodes.

10. An AC plasma display comprising:

a hermetically sealed gas filled enclosure, the enclosure including a top transparent substrate having an array of paired top substrate electrodes and an electron emissive and insulating film covering the top substrate electrodes; a bottom substrate spaced from but in contact with the top transparent substrate, the bottom substrate having a plurality of parallel micro-grooves arranged orthogonally to the top substrate electrodes and forming gas filled cavities; a bottom substrate electrode formed of metal and deposited within each the microgroove including bottom and side-walls; and a phosphor material deposited on and coincident with each the bottom substrate electrode thereby forming sub-cell pairs called sub-pixels at the projected intersections of top electrodes forming rows and microgrooves forming columns;

a first circuit connected to each first electrode of paired top substrate electrodes for generating a common multi level sustain first voltage waveform with a selective negative addressing pulse for each electrode;

a second circuit connected to each second electrode of paired top substrate electrodes for generating a common multilevel sustain second voltage waveform of opposite polarization and amplitude from the first electrode with a selective positive addressing pulse for each electrode;

a third circuit connected to each electrode on the bottom substrate for generating a common multi level sustain third voltage waveform with a selective positive addressing pulse for each electrode;

a fourth circuit including an input converter, frame buffer, and data transform circuit with an external interface capable of transferring row data in parallel to the third circuit;

a fifth circuit including a waveform and waveform timing control circuit interconnected with the first, second, third and fourth circuits and determinant of timing and control of the sustaining circuits and addressing pulses so as to create sustain and address discharge pulses initiated by discharges to sidewalls; and a power circuit capable of supplying power to the first five circuits.

11. The AC PDP of claim 10 wherein the first and second sustain voltage waveforms have peaks in the range of 150 to 350 volts an third sustain voltage waveform has a peak between 40 to 100 volts.

12. The AC PDP of claim 10 wherein the first and second sustain voltages include a maintain time from 2 to 5 microseconds and the third sustain voltage includes a time for erasing of 0.5 to 1 microsecond, and a time for writing of 2 to 5 microseconds.

13. The AC PDP of claim 10 wherein the gas fill is of Xenon in a base gas ranging from 4% to 100% at a pressure of up to 600 torr.

14. The AC PDP of claim 13 wherein the gas fill is of Xenon in Neon ranging from 4% to 100% at a pressure of up to 600 torr.

15. The AC PDP of claim 13 wherein the gas fill is of Xenon in equal parts of Neon and Helium ranging from 4% to 100% at a pressure of up to 600 torr.

16. A method of operating an AC plasma flat-panel display having a hermetically sealed gas filled enclosure including a top transparent substrate and a bottom substrate spaced from the top substrate, the top substrate having an array of paired top electrodes and an electron emissive and insulating film covering the top electrodes, the bottom substrate having a plurality of parallel micro-grooves arranged orthogonally to the top electrodes forming gas filled cavities, a bottom electrode formed of metal and deposited within each micro-groove having a bottom and side-walls, and a phosphor material deposited on and coincident with each bottom electrode thereby forming sub-cell pairs at the projected intersections of the top electrodes forming rows and micro-grooves forming columns, wherein the method comprises the steps of:

applying a sustain step by applying a first voltage to a first electrode of the paired top electrode and a reference voltage to all bottom electrodes, the difference of sufficient magnitude to cause an initiating discharge to the sidewalls of the bottom electrodes intersected at a Paschen minimum only for sub-cells which have charges stored under corresponding top substrate electrodes, and applying a second voltage, of opposite polarity to the first voltage, to a second electrode of the paired top electrode which creates a lateral discharge between virtual electrodes, formed by the initiating discharges to the sidewalls, between sub-cells pairs at a pressure gap product value greater than the Paschen minimum, maintaining the voltages until the discharges extinguish thereby depositing charges under the top electrodes of opposite polarity, applying first terminating voltages to the first top electrodes and second terminating voltages to the second top electrodes to sweep residual charges in gas volume, and reversing the polarities of the first and second top electrodes and repeating the sequence continuously.

17. The method of claim 16 further comprising the step of selective addressing comprising the steps of:

applying a selective write step comprised of:

applying a write voltage of common polarity to a sustaining voltage to a first electrode of one or more pairs of top electrodes and a selective write voltage to selected bottom electrodes, the difference of sufficient magnitude to cause a discharge to sidewalls of all bottom electrodes intersected at the Paschen minimum, applying a write voltage of common polarity to a sustaining voltage to a first electrode of one or more pairs of top electrodes and an inhibit voltage to unselected bottom electrodes, the difference of sufficient magnitude to not cause a discharge to sidewalls of all bottom electrodes intersected, applying a second write voltage, of opposite polarity to the first write voltage, to the second electrode paired with the first electrode, and form lateral discharges between virtual electrodes formed by the discharges to sidewalls between sub-cells pairs at pressure gap product values greater than the Paschen minimum, and maintaining the write voltages until discharges extinguish thereby depositing and storing charges on the dielectric coating under the top electrodes; and a selective erase step comprised of:

applying an erase voltage of opposite polarity to a sustaining voltage to a first electrode of one pair of top electrodes and a column voltage to selected bottom electrodes, the resulting voltage of combined magnitude sufficient to cause a discharge to sidewalls of the selected bottom electrodes at the Paschen minimum but only at sub-cell sites which have charges stored under corresponding top electrodes, and maintaining the voltages until discharges extinguish thereby removing stored charges which prevent discharging at subsequent sustain steps.

18. A method of operating an AC plasma flat-panel display having a hermetically sealed gas filled enclosure including a top transparent substrate and a bottom substrate spaced from the top substrate, the top substrate having an array of paired top electrodes and an electron emissive and insulating film covering the top electrodes; the bottom substrate having a plurality of parallel micro-grooves arranged orthogonally to the top electrodes forming gas filled cavities; a bottom electrode formed of metal and deposited within each micro-groove having a bottom and side-walls; and a phosphor material deposited on each bottom electrode thereby forming sub-cell pairs called sub-pixels at the projected intersections of the top electrodes forming rows and microgrooves forming columns, wherein the method comprises the steps of:

applying a sustain step comprised of a applying a first voltage to the first electrodes of the top electrode pairs and a reference voltage to all bottom electrodes, the difference of sufficient magnitude to cause an initiating discharge to the bottom electrodes intersected at the Paschen minimum only for sub-cells which have charges stored under corresponding top substrate electrodes to form a virtual electrode, and applying a second voltage, of opposite polarity to the first voltage, to the second electrodes paired with the first electrodes to form a virtual electrode and which creates a lateral discharge between the virtual electrodes, formed by the initiating discharges, between sub-cells pairs at a pressure gap product value greater than the Paschen minimum, maintaining the voltages until the discharges extinguish thereby depositing charges under the top electrodes of opposite polarity, applying first terminating voltages to the first top electrodes and second terminating voltages to the second top electrodes as required to sweep residual charges in gas volume, and reversing the polarities of the first and second top electrodes and repeating the sequence continuously in conjunction with optional selective addressing steps comprising:

applying a selective write step comprised of:

applying a write voltage of common polarity to a sustaining voltage to a first electrode of one or more pairs of top electrodes and a selective write voltage to selected bottom electrodes, the difference of sufficient magnitude to cause a discharge to all bottom electrodes intersected at the Paschen minimum, applying a write voltage of common polarity to a sustaining voltage to a first electrode of one or more pairs of top electrodes and an inhibit voltage to unselected bottom electrodes, the difference of sufficient magnitude to not cause a discharge to all bottom electrodes intersected, applying a second write voltage, of opposite polarity to the first, to the second electrode paired with the first electrode, and form lateral discharges between virtual electrodes formed by the discharges between sub-cells pairs at pressure gap product values greater than the Paschen minimum, and maintaining the voltages until discharges extinguish thereby depositing and storing charges on the dielectric coating under the top electrodes; and a selective erase step comprised of:

applying an erase voltage of opposite polarity to a sustaining voltage to a first electrode of one pair of top electrodes and a column voltage to selected bottom electrodes, the resulting voltage of combined magnitude sufficient to cause a discharge to the selected bottom electrodes at the Paschen minimum but only at sub-cell sites which have charges stored under corresponding top electrodes, and maintaining the voltages until discharges extinguish thereby removing stored charges which prevent discharging at subsequent sustain steps.

* * * * *